United States Patent [19]

Ducourroy et al.

[11] Patent Number: 5,065,131

[45] Date of Patent: Nov. 12, 1991

[54] ELECTRIC IMMERSION HEATER

[75] Inventors: André Ducourroy, Croissy s/Seine; Richard Jaume, Moret s/Loing, both of France

[73] Assignee: Electricite de France (Service National), Paris, France

[21] Appl. No.: 381,659

[22] PCT Filed: Oct. 21, 1988

[86] PCT No.: PCT/FR88/00520

§ 371 Date: Jun. 21, 1989

§ 102(e) Date: Jun. 21, 1989

[87] PCT Pub. No.: WO89/04108

PCT Pub. Date: May 5, 1989

[30] Foreign Application Priority Data

Oct. 21, 1987 [FR] France ..... 87 14532

[51] Int. Cl.[5] ..... H01C 1/026

[52] U.S. Cl. ..... 338/237; 373/134

[58] Field of Search ..... 219/523, 536; 338/234, 338/235, 236, 237; 373/132, 133, 134

[56] References Cited

U.S. PATENT DOCUMENTS

| | | | |
|---|---|---|---|
| 4,016,403 | 4/1977 | Best | 373/134 |
| 4,215,233 | 7/1980 | Kastilahn | 338/234 |
| 4,327,281 | 4/1982 | Jager et al. | 219/523 |
| 4,862,137 | 8/1989 | Jaume | 338/237 |

FOREIGN PATENT DOCUMENTS

| | | |
|---|---|---|
| 1269749 | 6/1968 | Fed. Rep. of Germany . |
| 759476 | 2/1934 | France . |
| 2413011 | 7/1979 | France . |
| 2463563 | 2/1981 | France . |

*Primary Examiner*—Geoffrey S. Evans

*Attorney, Agent, or Firm*—Fleit, Jacobson, Cohn, Price, Holman & Stern

[57] ABSTRACT

An immersion heater for a fluidized bed decarbonation reactor includes an elongate cylindrical graphite heating element within a sealed chamber into which an inert gas, such as argon, is introduced for protecting the heating element from oxidation and from which the gas may be removed. The chamber is defined by a refractory metal sheath with longitudinal corrugations and externally covered by a protective layer formed by chromaluminization. An insulating refractory metal ring centers and holds the heating element within the sheath to prevent short circuits between the heating elements and the sheath. A composite metal plate holds the heating element and includes input and output electrical supply bars for providing power to the heater.

10 Claims, 6 Drawing Sheets

ELECTRIC IMMERSION HEATER

BACKGROUND OF THE INVENTION

1. Technical Field

The invention relates to devices for electrically heating a medium by resistance, which devices are further commonly called immersion heaters, of the type comprising a substantially cylindrical elongate graphite heating element, surrounded by a refractory material sheath defining, about the heating element, a sealed chamber retaining a gas capable of protecting the graphite from oxidation.

It finds a particularly important, although not exclusive, application in the field of electric heating devices reaching, in furnaces where a corrosive or oxidizing atmosphere prevails, temperatures as high as those reached by the use of a fossil fuel.

2. Electric heating prior art devices of the above defined type are already known. In particular, in the patent application FR-A-84 02358, the applicant describes a device comprising a graphite heating element protected against oxidation by an atmosphere containing carbon monoxide formed from the heating element when the device is first put into use and surrounded by a corrosion resistant tubular refractory ceramic sheath. This solution solves numerous problems.

However, the use of a ceramic sheath, whose heat conductivity is low, limits the power which can be dissipated per unit of surface.

SUMMARY OF THE INVENTION

It is an object of the invention to provide an improved electric heating device. It is a more particular object to provide a device which makes it possible to obtain a shape of sheath particularly favourable to the diffusion of the radiating heat coming from the graphite heating element, which was impossible with ceramic sheaths whose shape was limited to a cylinder of revolution or an oval, in that it overcomes the dangers of electric short circuits between the graphite heating element and the sheath, which dangers are caused by the movement and vibration of the device in its heated medium, in that it comprises means for fixing and centring the graphite heating element inside its sheath which considerably minimize the difficulties of fitting such a device and the problems met with during handling thereof, and in that it makes it possible to obtain a considerable life-span of the device through an inert gas supply system which is inexpensive, simple to use and easy to maintain, protecting the graphite element against oxidation.

To this end, the invention provides more particularly an electric heating device of the above defined type, characterized:

in that the sheath is made from refractory metal alloy sheeting resisting the corrosion of the medium or is coated with a substantially constant protective external metal layer, in that said sheath has regular corrugations adapted so that all the points of the internal surface of the sheath see the heating element directly, in that said heating element is provided with two solid blocks forming a first end portion of said element and connected respectively to the input and output terminals of the electric power supply, and in that said graphite heating element comprises means for fixing and centring said heating element inside the sheath, said fixing and centring means comprising an insulating refractory material ring fixed on the second end portion of the graphite heating element and engaged in a cylindrical skirt fixed on the internal portion of the sheath, so that centring of the graphite element with respect to the sheath at the level of the second end portion of said element is provided, and a composite bed plate for fixing the graphite heating element and supplying it with electricity, which is removably fixed on the first end portion of said element and on which are fixed input and output bars for the electric power supply, said bed plate being formed by two metal portions forming respectively the electric input and output terminals of said graphite element, said metal portions being insulated electrically and fixed rigidly together by means of a ceramic insulating plate.

In an advantageous embodiment of the device applied to a heating element used in a vertical position, the latter comprises a mounting and handling plate disposed under the second end portion of the heating element, resting on the bottom of the sheath and comprising means for connection to a handling rod. By connecting a handling rod to the plate connection means, over the top of the device and passing through the graphite element, the graphite element can be raised, the plate supporting from underneath said graphite element and the portions and electric connections fixed above and which form a unit fast with the element.

It is also advantageous to provide electric insulating means placed between the second end portion of the heating element and the mounting and handling plate, which avoids any risk of short-circuits by preventing the graphite element from coming into contact with the bottom of the sheath.

In advantageous embodiments, recourse will also be had to one and/or other of the following arrangements:

the device comprises a system for supplying the sealed chamber with a gas for protecting the graphite heating element from oxidation and for removing said gas, connected to the sealed chamber by at least one gas inlet passage situated on one of the two end portions of the sheath and by at least one outlet passage for the gas situated on the other end portion of the sheath, so that a flow of protective gas may be formed in said sealed chamber between the two end portions, the system for supplying and removing the protective gas comprises a box for distributing the injected gas, fixed to an end or end portion of the sheath and, for each corrugation of the sealed chamber, a passage, for supplying from said box, the corresponding chute defined by the portion of the corrugation whose concavity is directed inwardly of the sheath, the protective gas is an inert gas such as argon, the ratio between the developed circumference of the sheath and the circumference of the circle passing through the tops of the corrugations the closest to the axis of the device is between 2.5 and 4, the external protective layer of the sheath is obtained by a treatment called chrome-aluminization and is of a thickness between a few microns and a few hundred microns, the external protective layer of the sheath is obtained by a treatment called "Sermetel J".

Generally, this device can be used in any fluid heating process, but it is particularly interesting in fluidized bed reactors or furnaces.

Its applications are numerous and diversified. Among these may be mentioned decarbonation, calcination, pyrolysis, the elimination of solvents, chemical catalysis, chemical reactions taking place at less than 900° C., etc . . .

In an advantageous embodiment, the above described device is constructed and used in a fluidized bed decarbonation reactor.

BRIEF DESCRIPTION OF THE DRAWINGS

The invention will be better understood from the following description of a particular embodiment given by way of non limitative example.

DETAILED DESCRIPTION OF A PREFERRED EMBODIMENT

Figures 1, 2, 3:
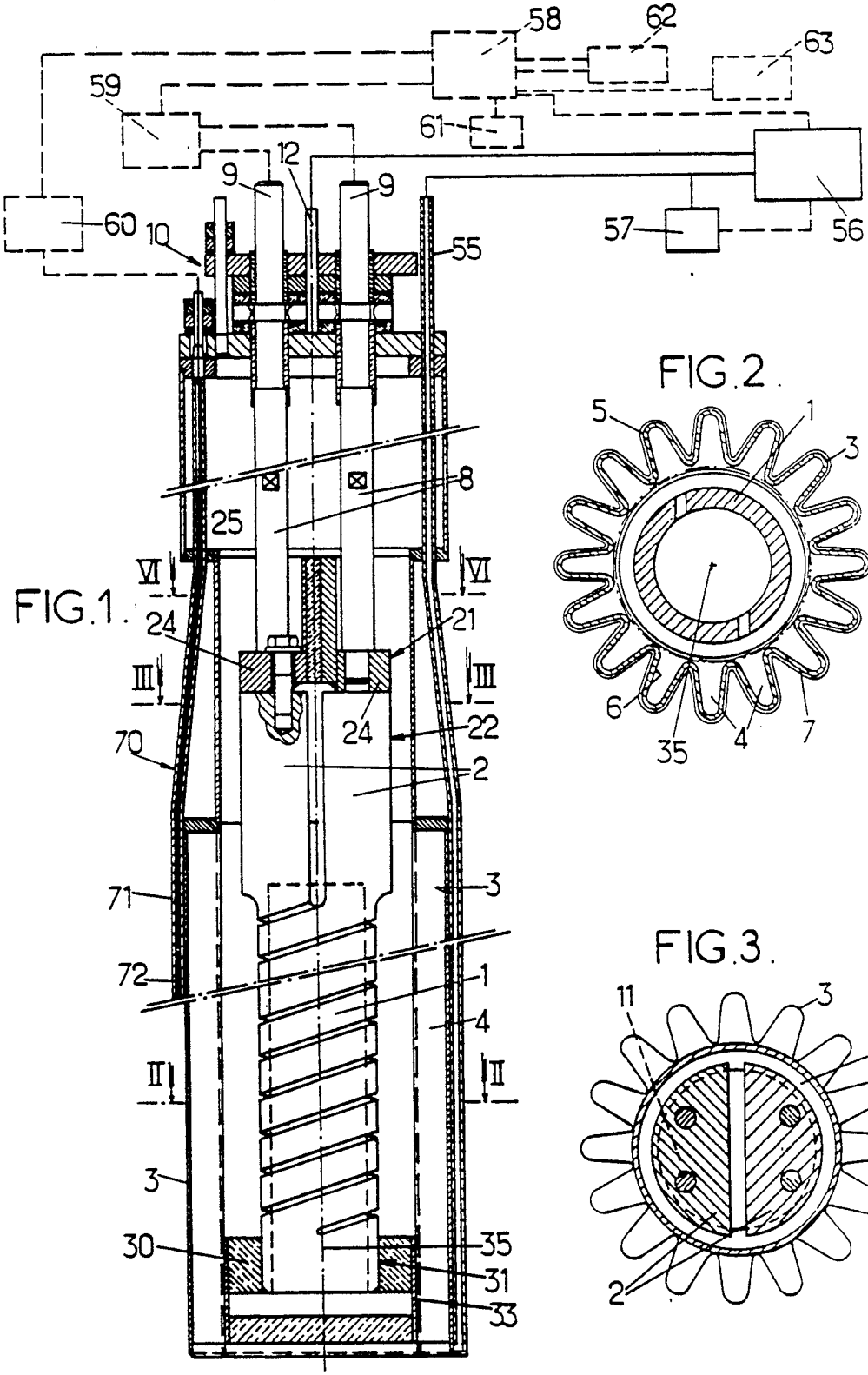
FIG. 1 is an elevational view of a heating device of the invention partially in section.
FIG. 2 is a cross sectional view through II—II of FIG. 1.
FIG. 3 is a cross sectional view through III—III of FIG. 1.

FIG. 1 shows an electric heating device according to the invention. It is formed of an elongate graphite heating element 1, of a general substantially cylindrical shape. More precisely, it has a double helical shape in the heating part and is provided with two solid portions or blocks 2 separated from each other at one of its ends for connecting the electric connections thereto. One solid portion is reserved for the power supply input and the other for the output. The double helix extends the electric path, so increases the resistance. In addition, by adjusting the different parameters of the helix (pitch, length and thickness of the helix portion, mean diameter) the resistance can be adapted to the needs or requirements imposed, such for example as the size or the maximum admissible voltage. With an element in accordance with the invention, heights of the graphite heating element can be reached of the order of two metres, which makes an overall height of the device of about three metres.

The graphite element 1 is surrounded by a sheath 3 defining about the heating element 1 a sealed chamber 4 retaining an inert gas such as argon. The sheath is made from refractory metal alloy sheeting resisting the corrosion of the medium in which it is placed and may be covered with an external protective layer 5 (see FIG. 2) of substantially constant thickness, for example 10 microns. It has regular corrugations as can be clearly seen in FIGS. 2 and 3. These corrugations are disposed so that all the points of the internal surface 6 of the sheath "see" the heating element 1 directly and so that the exchange surface 7 of the device with the medium is large. The ratio between the developed circumference of the sheath and the circumference of the circle (shown with dash dot lines in FIG. 2) passing through the top of the corrugations the closest to the axis of the device is between 2.5 and 4. In the embodiment shown in the Figures, it is of the order of 3.5.

The electric connections between the graphite heating element and the power supply source are two in number. They are each formed by a steel bar 8, threaded at both its ends, making it possible to support and position the graphite element 1 axially and radially and to let the current pass from the connections 9 external to the device towards the solid portions 2 of heating element 1. These bars 8 also play a role in the heat insulation of the plate 10 with respect to the heating element 1.

Figure 4:
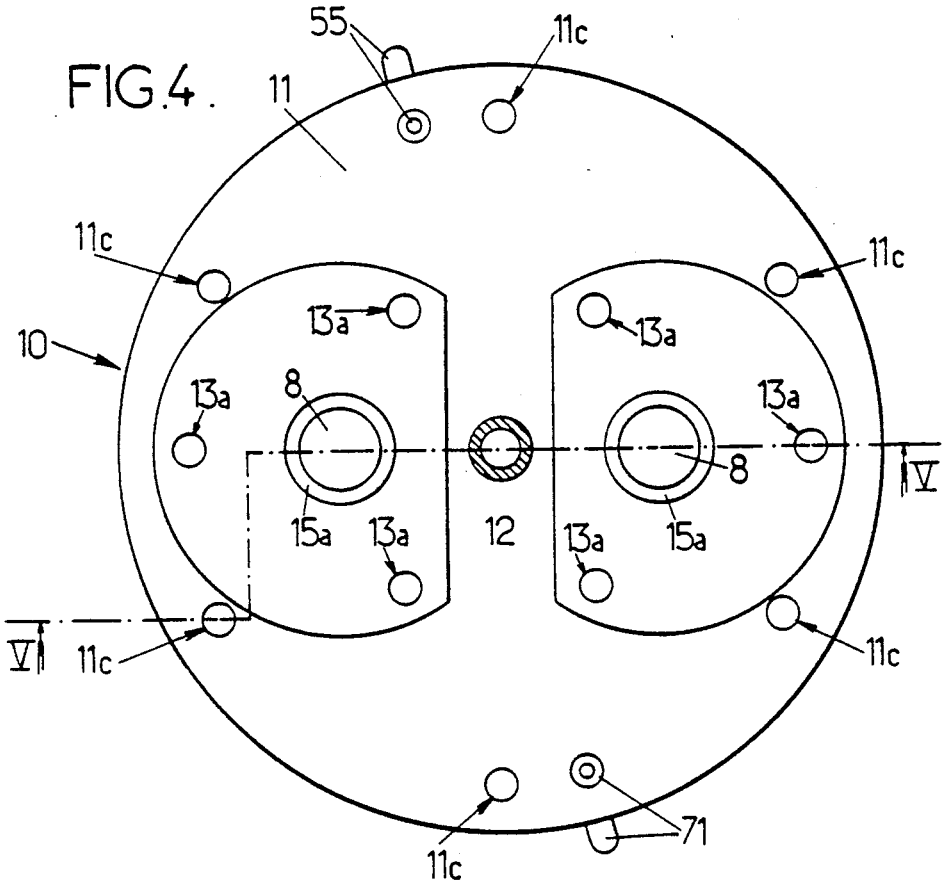
FIG. 4 is a schematic top view of FIG. 1.
Figure 5:
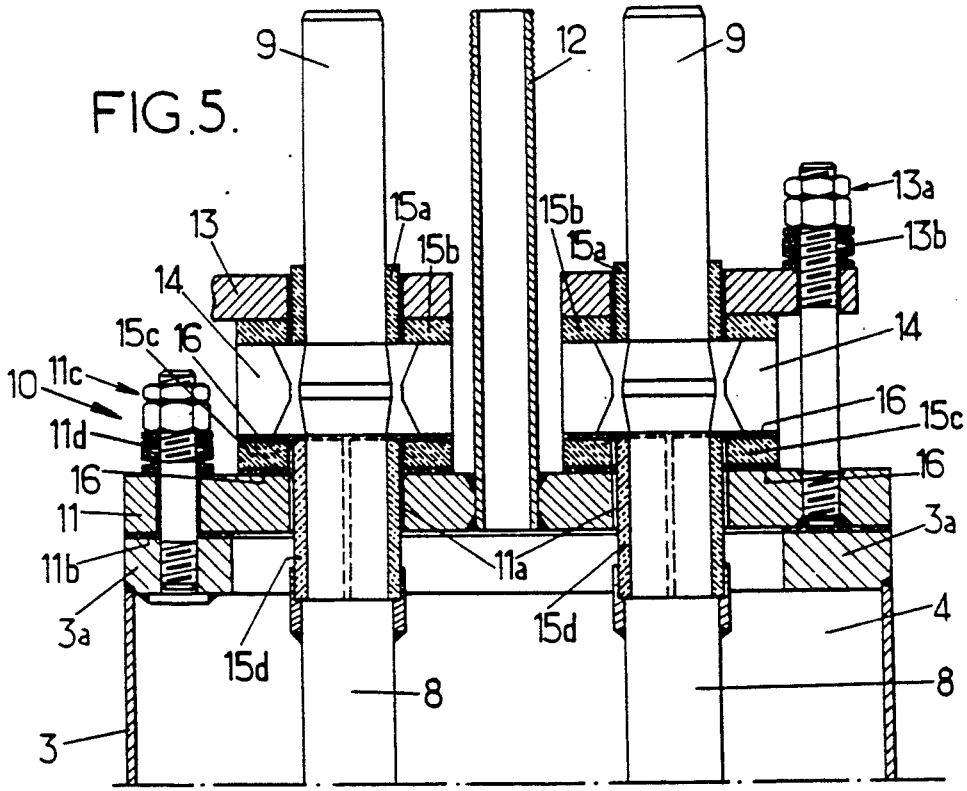
FIG. 5 is a partial section through V—V of FIG. 1.
Figure 6:
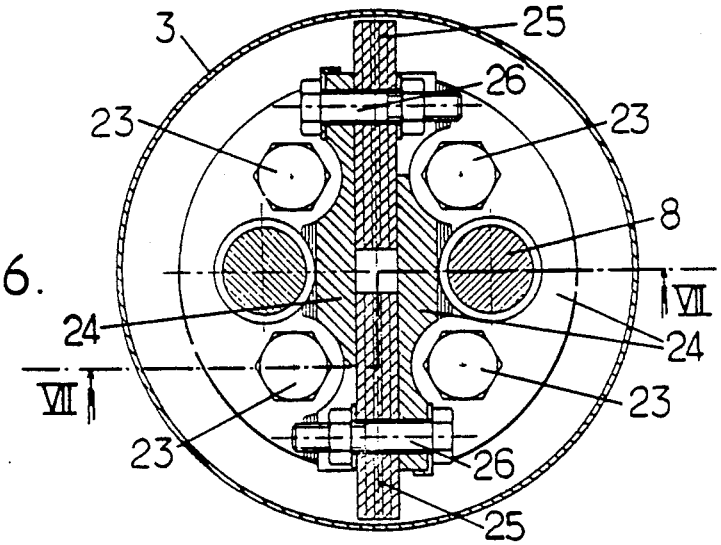
FIG. 6 is a sectional view through VI—VI of FIG. 1.
Figure 7:
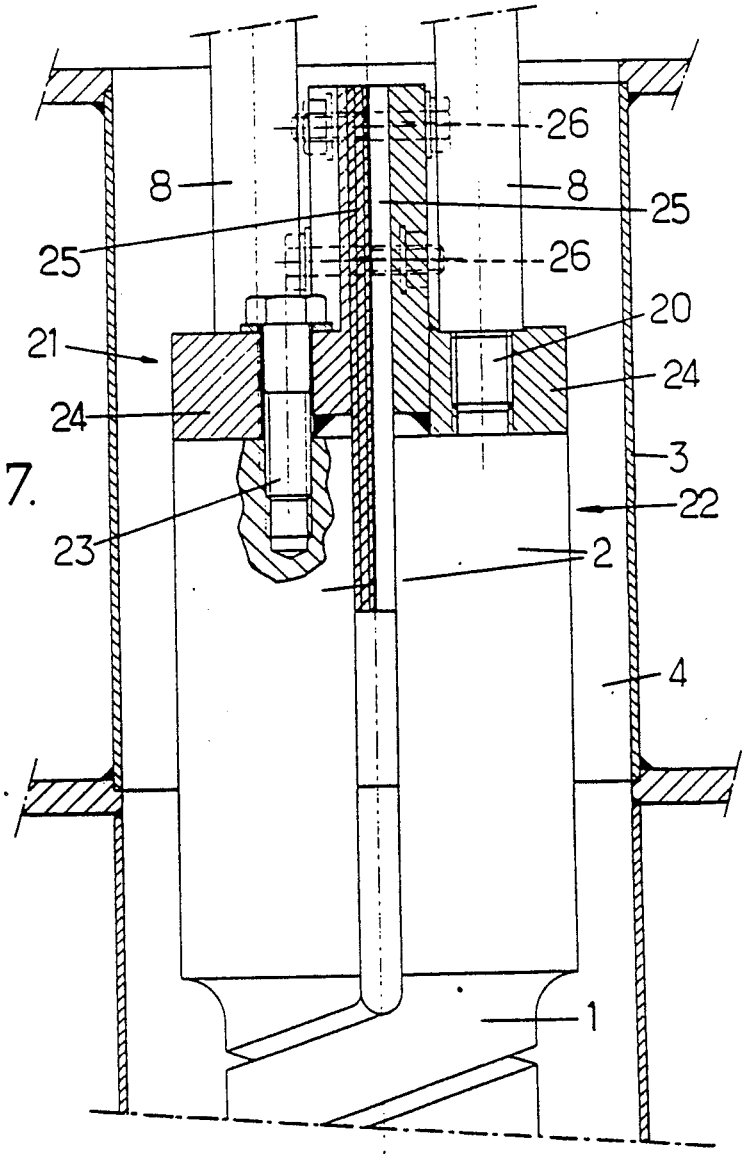
FIG. 7 is a partial sectional view through VII—VII of FIG. 6.
Figure 8:
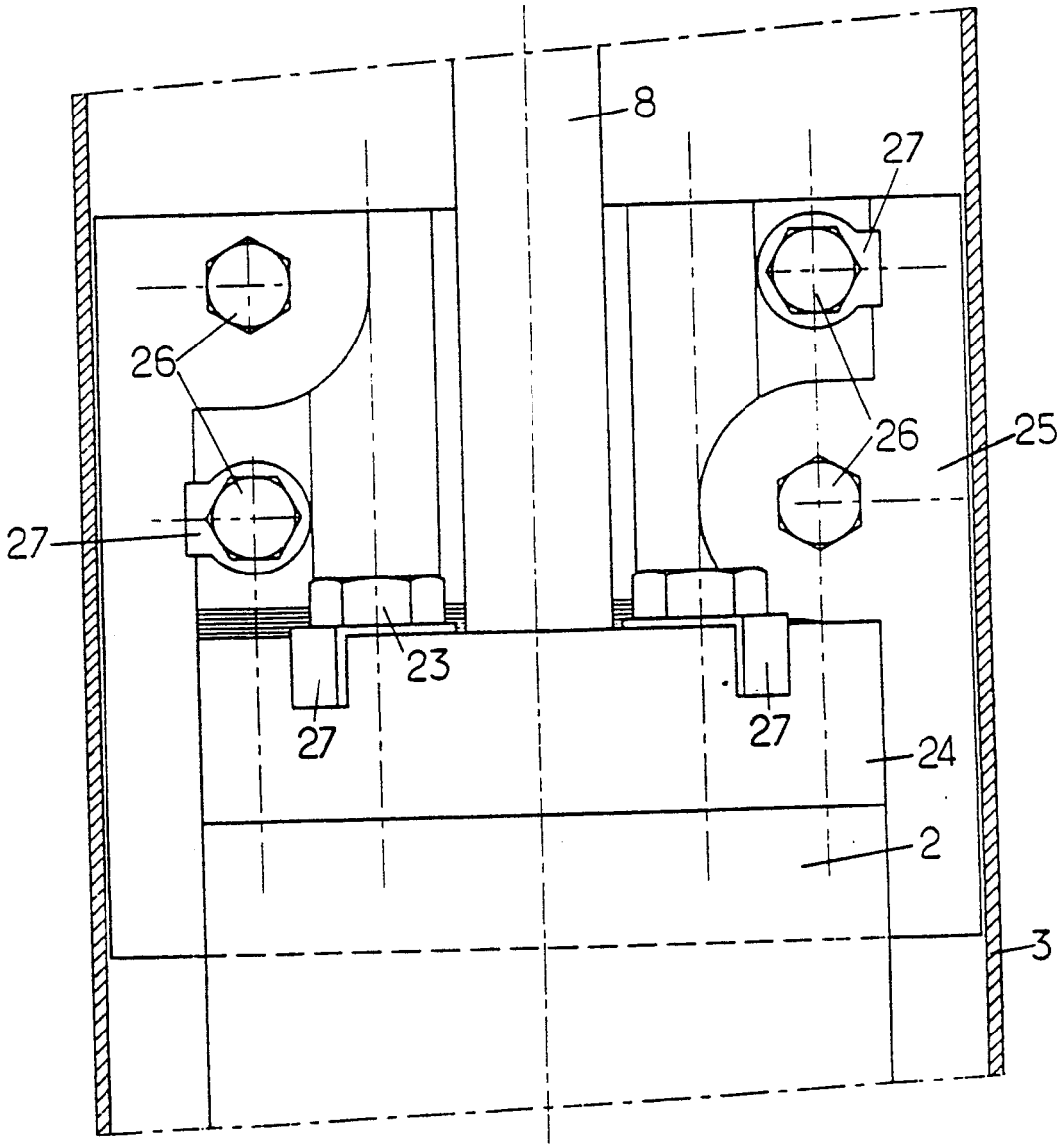
FIG. 8 is a partial front view of the fixing bed plate of FIG. 1.

Plate 10 is shown more precisely in FIGS. 4 and 5. It is a composite part based on ceramic insulating pieces and different metal pieces, for example made from the same material as the sheath, for clamping the plate on the sheath so as to seal chamber 4. Plate 10 serves for supporting the heating element, closing the device and provides electric insulation between the terminals.

More precisely, it comprises a metal piece 11 with two passages 11*a* for the supply and support bars 8. Seals 11*b* between the upper part 3*a* of sheath 3 and piece 11 provide sealing, knowing that clamping means 11*c*, comprising for example Belleville sealing washers 11*d*, place piece 11 under compression on sheath 3. Piece 11 further comprise a central tube 12 for removing the inert gas serving for protecting the graphite heating element against oxidation. A clamping flange 3 with its clamping means 13*a* comprising a differential compensation system of the Belleville washer type 13*b* places seals 13 under compression with the shoulders 14 welded to bars 8 and providing sealing of these bars 8 with respect to the outside. Ceramic insulating pieces 15*a*, 15*b*, 15*c*, 15*d* provide the electric insulation of the bars with the rest of the metal portions of the plate. Each piece 15*d* is formed by two half cylinders, so as to permit fitting thereof on bars 8. Seals 16 are also provided. They withstand relatively high temperatures and may for example be made from an insulating material of the type known under the name of Klingerite.

When the device is sealingly closed, plate 10 permits the retention of the inert gas in the retention chamber 4. Through the arrangement such as described of plate 10, a good distribution of the clamping forces is provided. The temperature at the level of the plate may be of the order of 300° C.

The seals may also be made from expanded graphite, from an asbestos compound or of the metallo-plastic type capable of maintaining its sealing properties up to temperatures of about 900° C.

In FIGS. 6 to 9 the means for fixing and centring the heating element 1 inside sheath 3 are shown more precisely.

Figure 10:
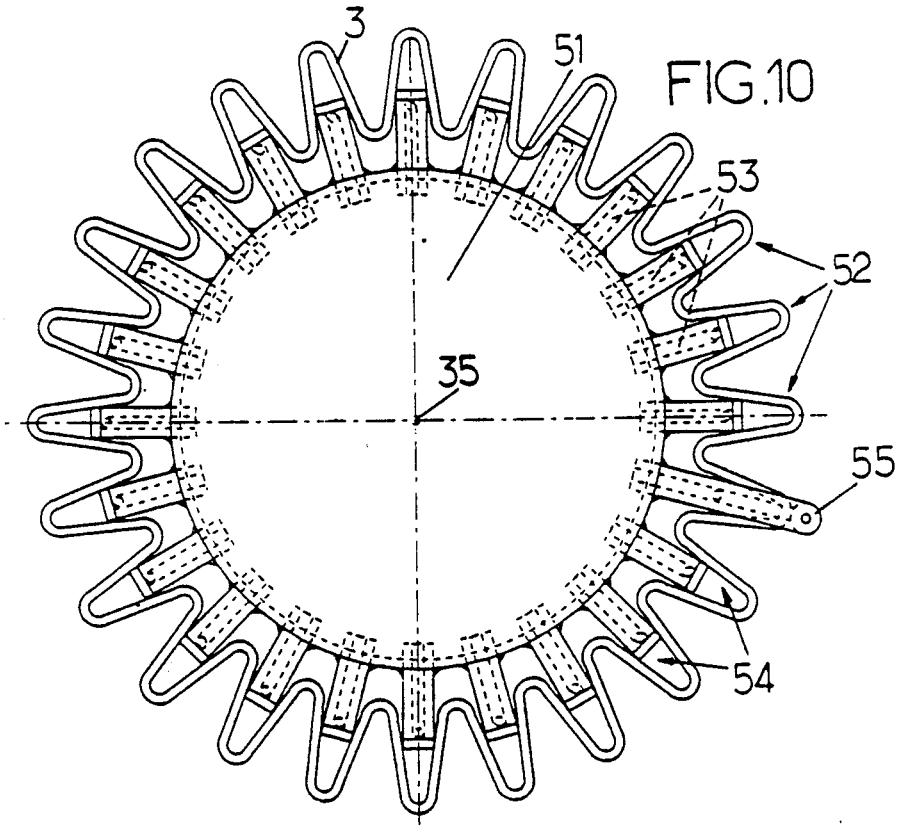
FIG. 10 is a bottom view of FIG. 1.

The electric power supply bars 8 are fixed by screwing means 20 (see FIG. 10) on a composite bed plate 21 for fixing the graphite heating element and supplying it with electric power. The bed plate 21 is itself fixed to the first end portion 22 of the graphite element 1 by screws 23, screwed into tapped holes in the solid blocks 2 of the elongate heating element 1. These solid blocks remain relatively cold. The fixing and power supply bed plate is formed by two metal portions 24 forming respectively the electric input and output terminals for the graphite element. These metal portions 24 are insulated electrically and fixed rigidly together by means of an insulating plate, made for example from ceramic, 25. The fixing means are formed by bolts 26 bearing on one side on the metal piece (through the head for example) and on the other on the insulating material (through the nut), so that no electric contact exists between the two metal input-output terminals (see FIG. 6).

The ceramic insulating plate may be made from any other electrically insulating material withstanding the operating temperatures. The fixing means are obviously locked, for example by bent tongues 27, in accordance with the rules of the art so as to avoid the loss of bolts or screws inside the device.

Figure 9:
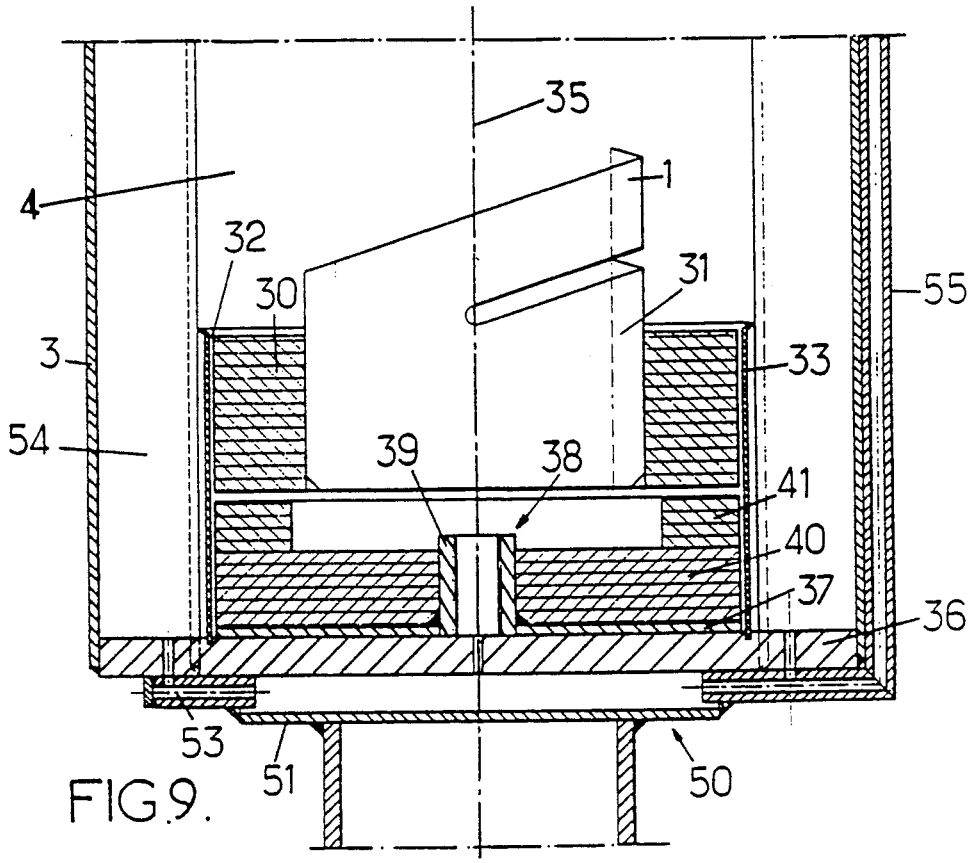
FIG. 9 is a partial sectional view of the other end portion of the heating element and of the device of the invention.

FIG. 9 shows the lower portion of the means for fixing and centring the graphite heating element in its sheath 3. An insulating ring 30 made from ceramic fibre or refractory concrete formed for example of stacks of discs, is force fitted or mechanically fixed on the second end portion 31 of the heating element. This insulating ring is engaged with sufficient clearance 32, e.g. 5 mm, in a cylindrical skirt 33 fixed on the internal portion of the sheath, inside the tops of the corrugations the closest to the central axis 35 of the heating element. Centring of the graphite element with respect to the sheath, in the bottom part of said element, is thus provided. On the bottom 36 of the sheath rests a mounting and handling plate 37 comprising connection means 38, formed for example by a threaded portion formed in a tube 39 welded to plate 37. Electric insulating means 40, 41 rest on plate 37 and are therefore interposed between the second end portion 31 of the heating element and the mounting and handling plate 37.

Electric insulating means 40, 41 avoid essentially the dangers of contact between the graphite element 1 and the bottom of the sheath of the device, which would cause short-circuits.

FIG. 9 further shows the lower portion of the system 50 for supplying the sealed chamber 4 with a gas protecting the graphite heating element against oxidation, for example an inert gas such as argon.

The supply system 50 comprises a distribution box 51 fast with the bottom 36 of the sheath, for example by welding and, for each corrugation 52 of the sealed chamber, a passage 53 for supplying the corresponding chute 54 (defined by the concave portion of the corrugation directed inwardly of the sealed chamber) from box 51, so that the protective gas fills the sealed chamber 4 entirely. The distribution box 51 is fed with inert gas through a duct 55 fast with sheath 3 and which rises as far as the top part of the device (see FIG. 4). It is connected to the inert gas supply means 56 (see FIG. 1) for example by a removable pipe having a quick-fit sealed connection withstanding high temperatures. The inert gas supply means 56 comprises a device 57 (transmitter, pressure controller . . . ) for measuring and controlling the static pressure present in the ducts and the sealed chamber 4. An additional inert gas injection is provided, for example automatically, by a programmable controller 58 should the pressure drop below a chosen nominal operating value. This function may also be fulfilled by a low pressure reducing valve situated close to the immersion heater connected to the input 55 and through a valve connected to the output 12. The controller advantageously also controls the electric power which supplies the heating element through terminals 9 and bars 8 from a power supply source 59. This source may of course supply several devices in accordance with the invention. Sheath 3 further comprises means 70 for measuring the temperature of the heating element. These means 70 are formed by guide tubes 71 fast with the sheath and in which thermocouples 72 are placed respectively which are connected to temperature measurement means 60 also connected to the controller.

The controller is advantageously provided with a control console or desk 61 and may be connected to computing means 62 and data recording means 63 for driving and monitoring the operation of the whole of the device.

In FIGS. 1, 4 and 9, a single thermocouple guide tube has been shown, but several tubes may be provided. In general, a single guide tube for lowering a thermocouple in the middle of the heating part of the graphite heating element is sufficient.

In FIG. 9, finally, under the argon distribution box 51, a centring tube fixed to the box has been shown partially, for positioning and centring the heating device in the furnace, for example with a fluidized bed, where it is used.

Figure 11:
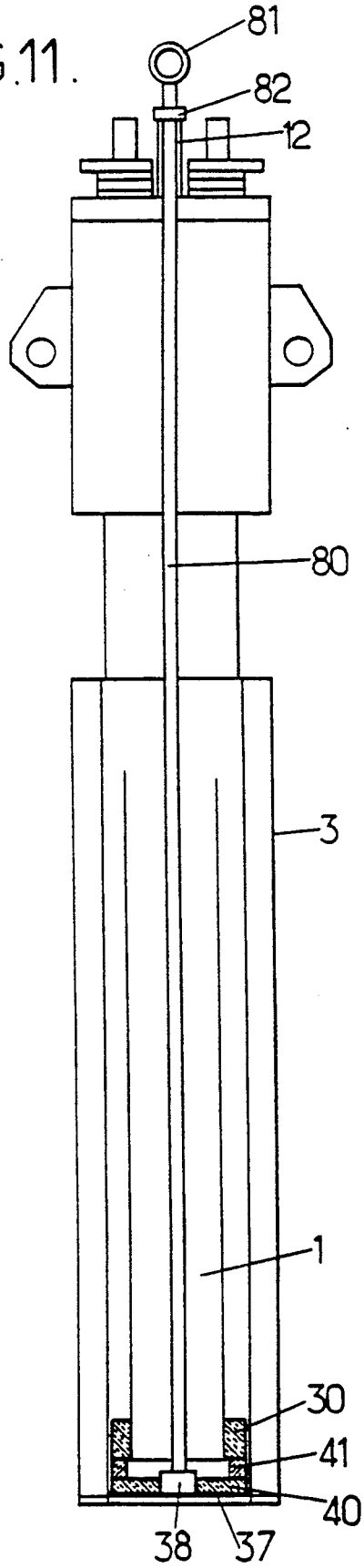
FIG. 11 is a schematic view partially in section of the device of the invention showing an arrangement for handling the device.

FIG. 11 shows a system for mounting and handling the heating device shown schematically. Through the argon removal tube 12, a rod 80 is introduced having a gripping ring 81, which is lowered to the bottom part of the device. This rod 80 has at its end a threaded portion which is screwed on the fixing means 38 of plate 37, remaining in the sheath during operation. The clamping nut 82 locks the mounting rod 80 at the top part. By means of a gantry crane, the device may be handled by taking it up by its ring 81, plate 37, when a tractive force is exerted on rod 82, being applied through the insulating discs 40, 41 on the lower part of the ring 30 fast with the graphite element. Thus, the graphite element does not risk moving inside its sheath and a good rigidity of the assembly is obtained.

A heating device of the above described type may be advantageously used in a fluidized bed reactor for a decarbonation process. In this case, sheath 3 may be made from a refractory metal protected by a deposit obtained by chrome-aluminization or by a coating known under the name of Sermetel J. The so-called chrome-aluminization process is a thermochemical diffusion treatment. The parts are plunged in a cement bath formed by about 80% chromium and 20% aluminium, diluted with $Al_2O_3$ in a proportion of approximately 50/50. The Sermetel J treatment is effected by the firm HEURCHROME (176, rue d'Estienne d'Orves—92700 COLOMBES). An aluminium plus silicon pigment is cold deposited by spraying. Stoving for fixing the pigment on its support is then carried out at about 360° C. A diffusion treatment at about 1000° C. of the treated parts ends the process.

The operation of the above described heating device is the following.

The device is introduced in its position in the fluidized bed furnace, by means of the above described mounting system. Then the mounting system is dismantled by removing the clamping nut 82 then by unscrewing rod 80, the mounting and handling plate 37 remaining in the sheath during operation. Then the input of the inert gas, for example argon, is connected to the pipe 55 supplying gas 12 and the oxygen contained in the sealed chamber is completely driven out. At the end of preparing the inert atmosphere of the chamber, the gas outlet pipe is positioned on the outlet connection 12 and a slight overpressure is left in the chamber, so as to provide dynamic confinement of the inside of the sheath.

The whole of the inert gas supply device is controlled by means of pressure sensors and the controller 58.

The electric connections are made to the portions 9 of supply bars 8 then the power build-up takes place, controlled and monitored by the means described above and known per se. A relatively constant pressure is maintained inside the sealed chamber by controlling the internal pressure of the device by the controller.

During operation, the pressure in the chamber is permanently measured and inert gas is introduced into or removed from said chamber as a function of the pressure drops or pressure increases above predetermined values.

The gas is introduced at one end and is removed from the other end of the sheath of device 1. The latter, for reasons related to its working, oscillates in temperature so as to maintain the bath in which it is situated at a constant temperature. A discontinuous flow of the inert gas results permitting renewal thereof. In fact, when the gas expands because of a temperature increase and so that the pressure inside the sheath is maintained constant, a certain amount escapes through circuit 56 comprising a valve. On the other hand, when the temperature drops again, the bath being restabilized at its nominal operating temperature, the chamber is under a depression with respect to its reference value. An amount of inert gas is then automatically injected so as to compensate for the loss of volume due to the contraction of the gases. This operation permits renewal of the inert gas required while consuming a negligible amount thereof.

The invention is in no wise limited to the embodiments which have been described, it covers all variants thereof and particularly:

the case where the regular corrugations do not have a rounded shape, such as described, but have sides with sharp angles, the case where the corrugations are separated by portions having no corrugations, the case where the sheaths of the device of the invention are obtained by bending metal sheet and are then closed on themselves by welding.

We claim:

1. Heating device for electrically heating a medium, comprising:

an elongate graphite heating element of substantially cylindrical shape about an axis, having two end portions;

a sheath surrounding said graphite heating element and defining an air-tight retention chamber about the heating element, made of refractory metal alloy sheet, having corrugations regularly distributed about said axis and so shaped that an internal surface of the sheath is in direct view of the heating element over substantially the whole area thereof;

a pair of mutually adjacent solid blocks formed at a first of the end portions of the graphite heating element, respectively connected to an input terminal and an output terminal which are connectable to an electric power supply;

and means for fixing and centering said graphite heating element within the sheath, including:

an electrically insulating refractory material ring fixed on the second of said end portions of the graphite heating element and engaged in a cylindrical skirt fixed on the internal portion of the sheath, whereby said second of said end portions of the graphite heating element is centered with respect to the sheath, and a composite bed plate for securing said graphite heating element and supplying it with electricity, said bed plate being formed as two metal portions forming secured electric input and output terminals for said graphite element, said metal portions being mutually insulated electrically and rigidly bonded together through a ceramic insulating plate, each of said metal portion being removably secured to a respective one of said solid blocks and each connected to a respective one of electric power supply bars.

2. Heating device according to claim 1, wherein said axis of said heating element is oriented vertically and wherein said heating element has an axial passage extending therethrough, said heating device further comprising a mounting and handling plate disposed under a lower one of said end portions of said heating element, said mounting and handling plate resting on a bottom wall of said sheath and being provided with connection means adapted to receive a handling rod removably insertable within and along said axial passage.

3. Heating device according to claim 2, further comprising electrically insulating means placed between said lower end portion of the heating element and said mounting and handling plate.

4. Heating device according to claim 1, characterized in that the device comprises a system for supplying the sealed chamber with a gas for protecting the graphite heating element from oxidation and for removing said gas, and in that said system is connected to the sealed chamber by at least one gas inlet passage, situated on one of the two end portions of the sheath and by at least one outlet passage for the gas, situated on the other end portion of the sheath, so that a flow of protective gas may be formed in said sealed chamber between the two end portions.

5. Heating device according to claim 4, characterized in that the system for supplying and removing the protective gas comprises a box (51) for distributing the injected gas, fixed to an end portion of the sheath and, for each corrugation of the sealed chamber, a passage for supplying from said box the corresponding chute defined by the portion of the corrugation whose concavity is directed inwardly of the sheath.

6. Heating device according to claim 4, characterized in that the protective gas is an inert gas.

7. Heating device according to claim 1, characterized in that the ratio between the developed circumference of the sheath and the circumference of the circle passing through the tops of the corrugations the closest to the axis (35) of the device is between 2.5 and 4.

8. Heating device according to claim 1, characterized in that the sheath is covered with an external protective layer resulting from chromaluminization and is of a thickness between a few microns and a few hundred microns.

9. Device according to claim 1, wherein said sheath is of metal alloy sheet externally coated with a layer of oxidation-resistant metal.

10. Heating device for electrically heating a medium, comprising:

an elongate graphite heating element of substantially cylindrical shape about an axis, having two end portions;

a sheath surrounding said graphite heating element and defining an air-tight retention chamber about the heating element, made of refractory metal alloy sheet, having corrugations regularly distributed about said axis and so shaped that an internal surface of the sheath is in direct view of the heating element and that the ratio between the developed circumference of the sheath and circumference of a circle passing through the top of the corrugations closest to said axis be between 2.5 and 4, a pair of mutually adjacent solid blocks formed at a first of the end portions of the graphite heating element, respectively connected to an input terminal and an output terminal which are connectable to an electric power supply;

and means for fixing and centering said graphite heating element within the sheath, including:

an electrically insulating refractory material ring fixed on the second of said end portions of the graphite heating element and engaged in a cylindrical skirt fixed on the internal portion of the sheath, whereby said second of said end portions of the graphite heating element is centered with respect to the sheath, and a composite bed plate for securing said graphite heating element and supplying it with electricity, said bed plate being formed as two metal portions forming secured electric input and output terminals for said graphite element, said metal portions being mutually insulated electrically and rigidgly bonded together through a ceramic insulating plate, each of said metal portion being removably secured to a respective one of said solid blocks and each connected to a respective one of electric power supply bars.

* * * * *